US009212517B1

(12) United States Patent
Reid

(10) Patent No.: US 9,212,517 B1
(45) Date of Patent: Dec. 15, 2015

(54) INDOOR SMOKING HOOD

(71) Applicant: Donald J. Reid, Smithtown, NY (US)

(72) Inventor: Donald J. Reid, Smithtown, NY (US)

( * ) Notice: Subject to any disclaimer, the term of this patent is extended or adjusted under 35 U.S.C. 154(b) by 594 days.

(21) Appl. No.: 13/687,199

(22) Filed: Nov. 28, 2012

(51) Int. Cl.
*E06B 7/02* (2006.01)
*E06B 7/03* (2006.01)

(52) U.S. Cl.
CPC ..... *E06B 7/03* (2013.01)

(58) Field of Classification Search
CPC ..... F24F 2011/022; F24F 2011/024; F24F 2221/12; F24F 2221/20; F24F 13/18; E06B 2007/023; E06B 7/02; E06B 7/03
USPC ..... 454/196, 112, 179, 197, 200, 208, 454/212–220, 49, 63, 65–67; 248/218.4, 248/219.1, 74.1, 231.81; 24/339, 545; 160/65; 416/246; 49/70; 52/285.3
See application file for complete search history.

(56) References Cited

U.S. PATENT DOCUMENTS 647,913 A * 4/1900 Cherry ..... 160/59
832,377 A * 10/1906 Haines ..... 454/216
969,687 A * 9/1910 Farlin ..... 160/54
1,060,727 A * 5/1913 Winn ..... 454/218
1,698,328 A * 1/1929 Duffie ..... 248/606
1,752,372 A * 4/1930 De Bothezat ..... 454/210
2,052,453 A * 8/1936 Dollinger ..... 454/207
D325,629 S 4/1992 Coup et al.
5,141,539 A 8/1992 Hiouani
5,407,389 A 4/1995 Poblete et al.
5,427,570 A 6/1995 Chen
5,529,078 A 6/1996 Rehder et al.
5,752,527 A 5/1998 Bowen et al.
7,147,553 B2 12/2006 Leask

* cited by examiner

*Primary Examiner* — Avinash Savani
*Assistant Examiner* — Vivek Shirsat

(57) ABSTRACT

The present invention features an indoor smoking hood system disposed on a sash window frame. The hood comprises a first side tubular frame and a second tubular frame. The frames are joined together by adjustment locks for the attachment of variable window width. The frames are attached to the window frame via a plurality of window clamps. A hood frame is slidably and pivotably attached to the first side tubular frame and second tubular frame. A clear plastic hood provides enclosure of the hood for a smoking area. A fan plate is attached to the top of the tubular frame with a plurality of fan plate clips. An exhaust fan is installed on the fan plate to air in the hood to outdoor.

7 Claims, 4 Drawing Sheets

INDOOR SMOKING HOOD

FIELD OF THE INVENTION

The present invention related to a smoking hood, and more particularly to a smoking hood disposed on a window frame fro reducing indoor smoke pollution.

BACKGROUND OF THE INVENTION

Many smokers feel the inconvenience of smoking outside, especially during the bad weather, such as windy, rainy, cold or hot days. However, some if not the majority offices, apartments, hotels requires a smoking-free indoor environment. Hence, there is a need for a solution which enables smokers to smoke inside while minimize the smoke pollution from cigarette.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features an indoor smoking hood system disposed on a sash window frame. The hood comprises a first side tubular frame and a second tubular frame. The frames are joined together by adjustment locks for the attachment of variable window width. The frames are attached to the window frame via a plurality of window clamps. A hood frame is slidably and pivotably attached to the first side tubular frame and second tubular frame. A clear plastic hood provides enclosure of the hood for a smoking area. A fan plate is attached to the top of the tubular frame with a plurality of fan plate clips. An exhaust fan is installed on the fan plate to air in the hood to outdoor.

DESCRIPTION OF PREFERRED EMBODIMENTS

Figure 1:
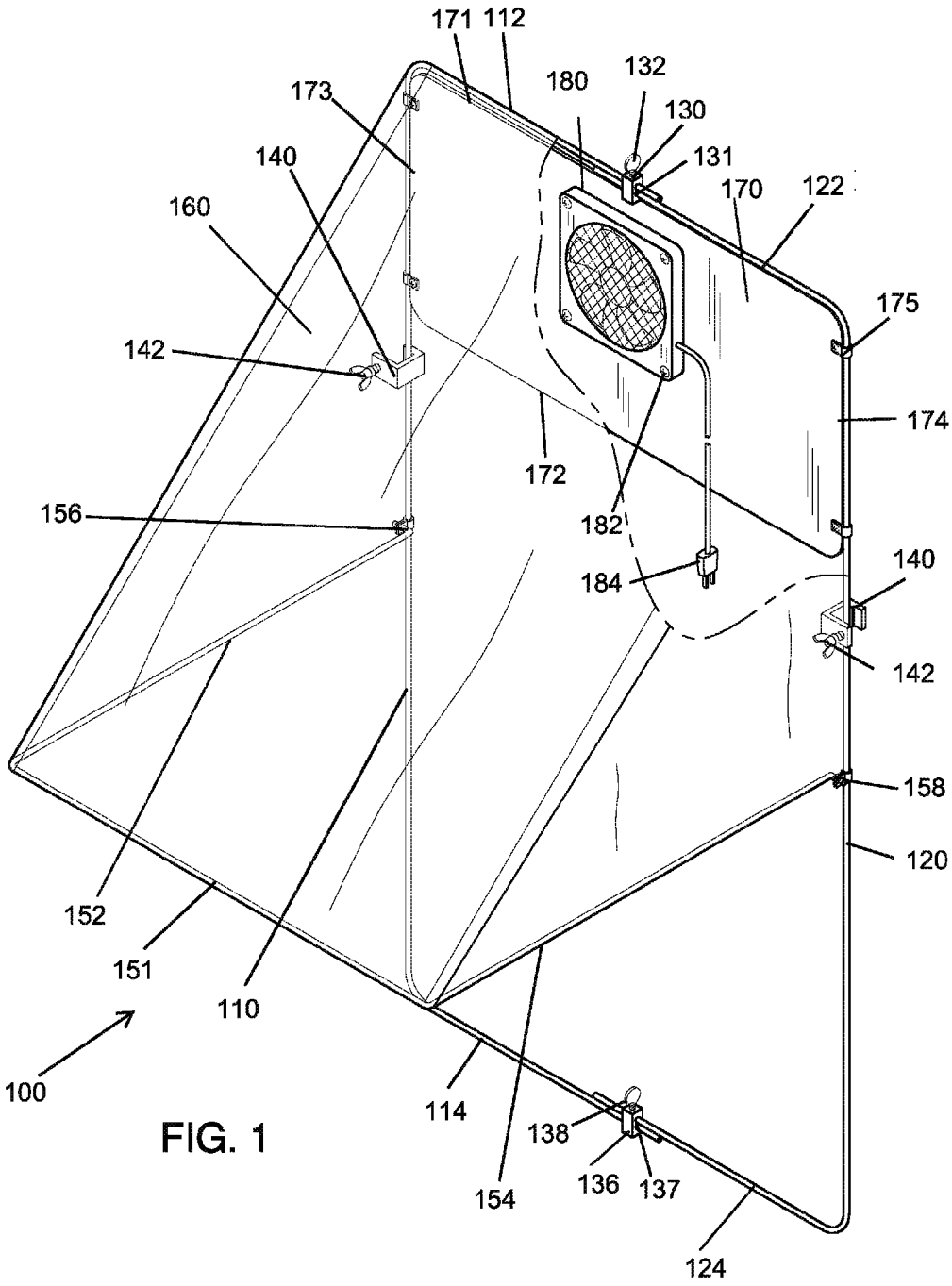
FIG. 1 shows an isometric view of a smoking hood.
Figure 2:
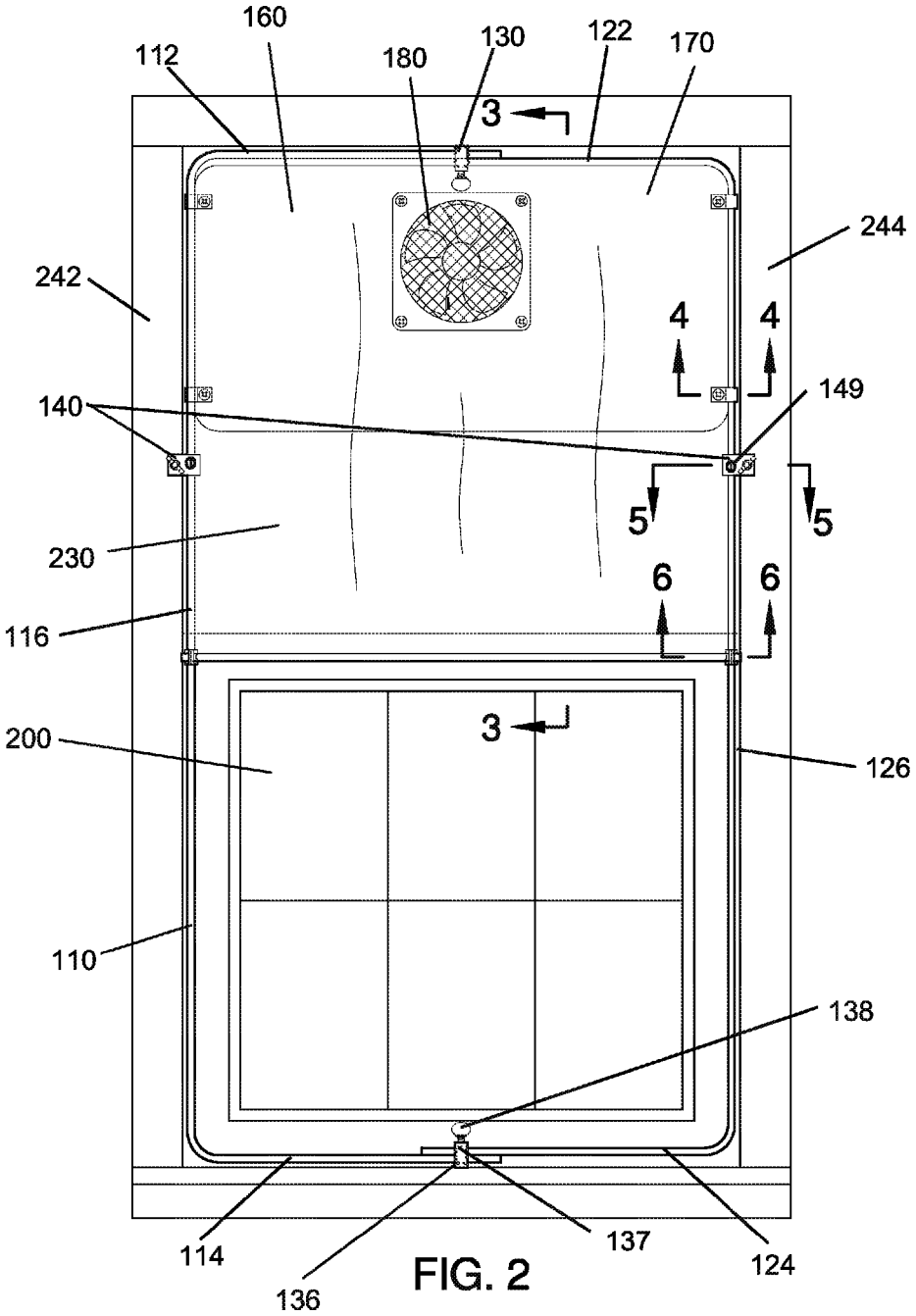
FIG. 2 shows a front view of a smoking hood.
Figure 3:
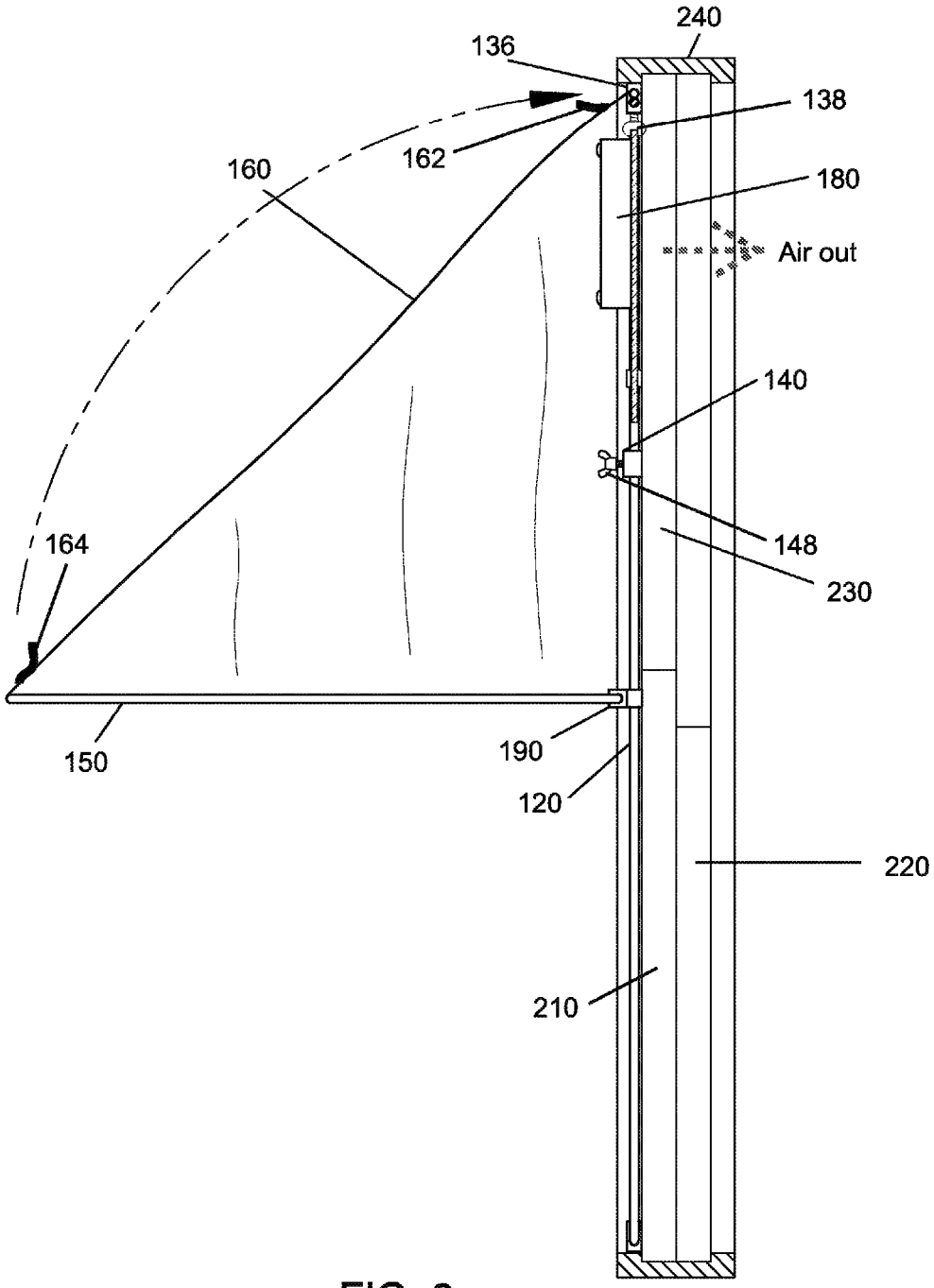
FIG. 3 shows a side view of a smoking hood.
Figure 4:
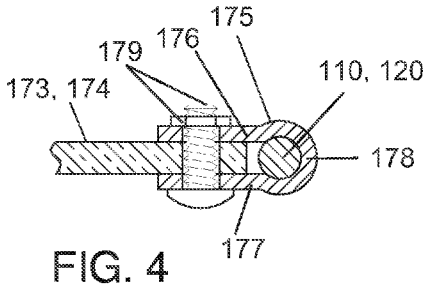
FIG. 4 shows a detailed view of attachment of fan plate to tubular frame.
Figure 5:
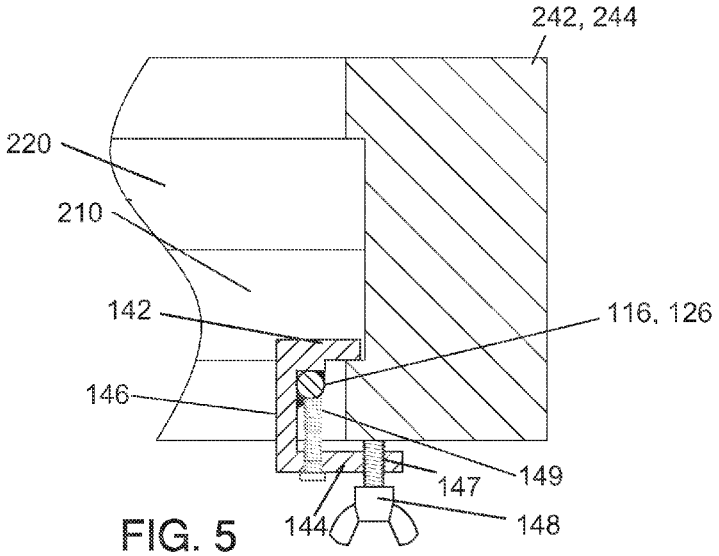
FIG. 5 shows a detailed view of attachment of tubular frame to window frame.
Figure 6:
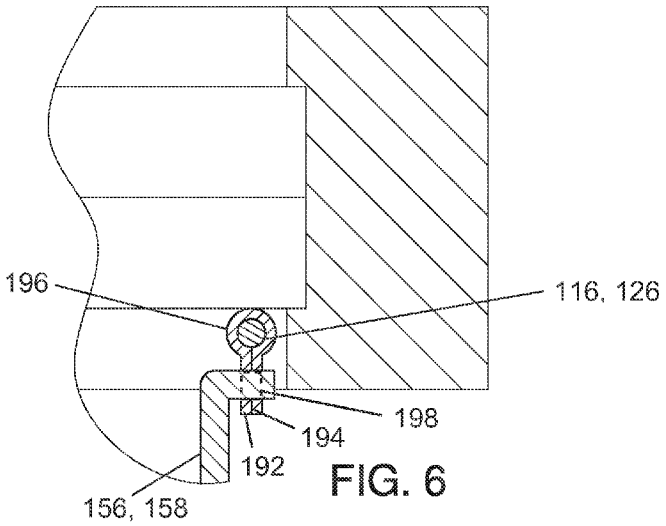
FIG. 6 shows a detailed view of attachment of hood frame to tubular frame.

Referring now to FIGS. 1-6 the present invention features an indoor smoking hood system (100) disposed on a sash window frame. The hood comprises a first side tubular frame (110) and a second tubular frame (120). The frames are joined together by adjustment locks (130, 136) for the attachment of variable window width. The frames are attached to the window frame via a plurality of window clamps (140). A hood frame (150) is slidably and pivotably attached to the first side tubular frame and second tubular frame. A clear plastic hood enclosure (160) provides enclosure of the hood for a smoking area. A fan plate (170) is attached to the top of the tubular frame with a plurality of fan plate clips (175). An exhaust fan (180) is installed on the fan plate to air in the hood to outdoor.

The indoor smoking hood system (100) comprises a sash window (200) having a first sash (210) and a second sash (220), wherein the sashes (210, 220) are able to slide down along a window frame (240) to create an opening (230), wherein the window frame (240) has a first side (242) and a second side (244). Sash window are well known to one with ordinary art in the field.

The indoor smoking hood system (100) comprises a first tubular frame (110) and a second tubular frame (120). The first tubular frame (110) has a U-shape profile with a top end arm (112), a lower end arm (114) and a central arm (116), wherein the top end arm (112) and lower end arm (114) are perpendicular to the central arm (116). The second tubular frame (120) has a U-shape profile with a top end arm (122), a lower end arm (124) and a central arm (126), wherein the top end arm (122) and lower end arm (124) are perpendicular to the central arm (126).

The indoor smoking hood system (100) comprises a first adjustment lock (130) and a second adjustment lock (136). The top end arm (112) of the first tubular frame (110) and the top end arm (122) of the second tubular frame (120) pass through an aperture (131) within the first adjustment lock (130) from opposite directions and are securely tightened by a first screw (132). The lower end arm (114) of the first tubular frame (110) and the lower end arm (124) of the second tubular frame (120) pass through an aperture (137) within the second adjustment lock (136) from opposite directions and are securely tightened by a second screw (138).

The indoor smoking hood system (100) comprises a plurality of window clamps (140) to securely attach the tubular frames to the window frame, wherein each window clamp (140) has a U-shape profile having a first clamp arm (142), a second clamp arm (144) and a central clamp arm (146), wherein the first clamp arm (142) and second clamp arm (144) are perpendicular to the central clamp arm (146), wherein the second clamp arm (146) has an aperture (147) for a third screw (148) to screw through and securely tighten to the first side (242) or second side (244) of the window frame (240), wherein the central arm of the first tubular frame (110) or second tubular frame (120) is firmly attached within the window clamps (140) via a secure means (149).

In some embodiments, the secure means (149) is welding the central arm of the first tubular frame (110) or second tubular frame (120) to the window clamps (140). In some embodiments, the secure means (149) is securing the central arm of the first tubular frame (110) or second tubular frame (120) to the window clamps (140) by a screw bolt, such that the window clamps (140) are able to slide up or down along the central arm of the first tubular frame (110) or second tubular frame (120) to a desired position.

The indoor smoking hood system (100) comprises a tubular hood frame (150) having a U-shape with a central hood arm (151), first side hood arm (152) and a second side hood arm (154), wherein the first side hood arm (152) and second side hood arm (154) are perpendicular to the central hood arm (151), wherein the first side hood arm (152) has a first distal end tip (156) perpendicular to the first side hood arm (152), wherein the second side hood arm (154) has a second distal end tip (158) perpendicular to the second side hood arm (154), wherein the tubular hood frame (150) is slidably and pivotably attached to the first tubular frame (110) and second tubular frame (120) via two pivot clips (190), wherein each pivot clip (190) comprises a first pivot arm (192), a second pivot arm (194) and a circular arm (196), wherein the central arm (116) of the first tubular frame (110) or the central arm (126) of the second tubular frame (120) are configured to slidably fit inside the circular arm (194), wherein the first pivot arm (192) and the second pivot arm (194) are aligned together and have a circular aperture (198), wherein the first distal end tip (156) or second distal end tip (156) is configured to pass through the circular aperture (198); wherein the tubular hood frame (150) is rotatable around the circular aperture (198).

The indoor smoking hood system (100) comprises a hood enclosure (160) expanding from the top end arm (112) of the first tabular frame (110) and the top end arm (122) of the second tabular frame (120) to the central hood arm (151) of the tubular hood frame (150). The hood enclosure also extends from the section of central arm (116) of the first tubular frame (110) above the pivot clip (190) to the first side hood arm (152), wherein the hood enclosure also extends from the section of central arm (126) of the second tubular frame (120) above the pivot clip (190) to the second side hood arm (154).

The indoor smoking hood system (100) comprises a fan plate (170) having a rectangle profile with a top side (171), lower side (172), a first side (173) and a second side (174), wherein the first side (173) and second side (174) are attached to the first tubular frame (110) and second tubular frame (120) respectively by at least one fan plate clip (175), wherein each fan plate clip (175) comprises a first clip arm (176), a second clip arm (177) and an arc-shaped arm (178), wherein the central arm (116) of the first tubular frame (110) or the central arm (126) of the second tubular frame (120) are configured to snuggly fit inside arc-shaped arm (178), wherein the first side (173) or second side (174) of the fan plate is disposed between the first clip arm (176) and second clip arm (177), wherein the first side (173) or second side (174) of the fan plate the first clip arm (176) and second clip arm (177) are securely tightened together via a secure screw and nut set (179).

The indoor smoking hood system (100) comprises a fan (180) disposed on the fan plate (170) by a plurality of fan securing screws (182), wherein the fan has a power plug (184) for power source connection, wherein after activated, the fan (180) functions to below the air within the hood enclosure (160) to outside such that when a smoker smokes inside the hood enclosure, the smoke pollution is pumped to outdoor with the elimination of potential indoor pollution.

In some embodiments, the hood enclosure (160) is collapsible. In some embodiments, the hood enclosure (160) is made of transparent materials, such as polypropylene film, polyethylene film, polycarbonate film, etc. The transparent materials would enable the smoker to have a clear view for indoor environment such as TV program, even within the hood enclosure. In some embodiments, the fan plate (170) is made of transparent materials to maintain the clear view of outdoor environment.

In some embodiments, the hood enclosure (160) further comprises a first secure strip (162) disposed adjacent to the first adjustment lock (130) and a second secure strap (184) disposed adjacent to the second adjustment lock (136), wherein when the hood enclosure (160) is in an storage position with the hood frame (150) rotating up, the first secure strip (162) is able to securely engage to the second strip (164) to keep the hood enclosure (160) in storage position. In some embodiments, the first secure strip (162) engages to the second strip (164) with a fasten-and-loop mechanism, a zipper mechanism, a button mechanism.

The disclosures of the following U.S. Patents are incorporated in their entirety by reference herein: U.S. Patent Document; U.S. Pat. Nos. 5,427,570, 5,529,078, 5,752,527, 7,147,553, U.S. patent D325629, U.S. Pat. Nos. 5,141,539 and 5,407,389.

Various modifications of the invention, in addition to those described herein, will be apparent to those skilled in the art from the foregoing description. Such modifications are also intended to fail within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An indoor smoking hood system (100) disposed on a sash window frame for a smoker to smoke inside, wherein the system comprises:

(a) sash window (200) having a first sash (210) and a second sash (220), wherein the sashes (210, 220) are able to slide down along a window frame (240) to create an opening (230); wherein the window frame (240) has a first side (242) and a second side (244);

(b) a first tubular frame (110), wherein the first tubular frame (110) has a U-shape profile with a top end arm (112), a lower end arm (114) and a central arm (116), wherein the top end arm (112) and lower end arm (114) are perpendicular to the central arm (116);

(c) a second tubular frame (120), wherein the second tubular frame (120) has a U-shape profile with a top end arm (122), a lower end arm (124) and a central arm (126), wherein the top end arm (122) and lower end arm (124) are perpendicular to the central arm (126);

(d) a first adjustment lock (130) and a second adjustment lock (136), wherein the top end arm (112) of the first tubular frame (110) and the top end arm (122) of the second tubular frame (120) pass through an aperture (131) within the first adjustment lock (130) from opposite directions and are securely tightened by a first screw (132); wherein the lower end arm (114) of the first tubular frame (110) and the lower end arm (124) of the second tubular frame (120) pass through an aperture (137) within the second adjustment lock (136) from opposite directions and are securely tightened by a second screw (138);

(e) a plurality of window clamps (140) to securely attach the tubular frames to the window frame, wherein each window clamp (140) has a U-shape profile having a first clamp arm (142), a second clamp arm (144) and a central clamp arm (146), wherein the first clamp arm (142) and second clamp arm (144) are perpendicular to the central clamp arm (146), wherein the second clamp arm (146) has an aperture (147) for a third screw (148) to screw through and securely tighten to the first side (242) or second side (244) of the window frame (240), wherein the central arm of the first tubular frame (110) or second tubular frame (120) is firmly attached within the window clamps (140) via a secure means (149);

(f) a tubular hood frame (150) having a U-shape with a central hood arm (151), first side hood arm (152) and a second side hood arm (154), wherein the first side hood arm (152) and second side hood arm (154) are perpendicular to the central hood arm (151), wherein the first side hood arm (152) has a first distal end tip (156) perpendicular to the first side hood arm (152), wherein the second side hood arm (154) has a second distal end tip (158) perpendicular to the second side hood arm (154), wherein the tubular hood frame (150) is slidably and pivotably attached to the first tubular frame (110) and second tubular frame (120) via two pivot clips (190), wherein each pivot clip (190) comprises a first pivot arm (192), a second pivot arm (194) and a circular arm (196), wherein the central arm (116) of the first tubular frame (110) or the central arm (126) of the second tubular frame (120) are configured to slidably fit inside the circular arm (194), wherein the first pivot arm (192) and the second pivot arm (194) are aligned together and have a circular aperture (198), wherein the first distal end tip (156) or second distal end tip (156) is configured to pass through the circular aperture (198); wherein the tubular hood frame (150) is rotatable around the circular aperture (198);

(g) a hood enclosure (160) expanding from the top end arm (112) of the first tubular frame (110) and the top end arm (122) of the second tubular frame (120) to the central hood arm (151) of the tubular hood frame (150), wherein the hood enclosure also extends from the section of central arm (116) of the first tubular frame (110) above the pivot clip (190) to the first side hood arm (152), wherein the hood enclosure also extends from the section of central arm (126) of the second tubular frame (120) above the pivot clip (190) to the second side hood arm (154);

(h) a fan plate (170) having a rectangle profile with a top side (171), lower side (172), a first side (173) and a second side (174), wherein the first side (173) and second side (174) are attached to the first tubular frame (110) and second tubular frame (120) respectively by at least one fan plate clip (175), wherein each fan plate clip (175) comprises a first clip arm (176), a second clip arm (177) and an arc-shaped arm (178), wherein the central arm (116) of the first tubular frame (110) or the central arm (126) of the second tubular frame (120) are configured to snuggly fit inside arc-shaped arm (178), wherein the first side (173) or second side (174) of the fan plate is disposed between the first clip arm (176) and second clip arm (177), wherein the first side (173) or second side (174) of the fan plate the first clip arm (176) and second clip arm (177) are securely tightened together via a secure screw and nut set (179); and (i) a fan (180) disposed on the fan plate (170) by a plurality of fan securing screws (182), wherein the fan has a power plug (184) for power source connection, wherein after activated, the fan (180) functions to blow the air within the hood enclosure (160) to outside.

2. The system of claim 1, wherein the hood enclosure (160) is collapsible.

3. The system of claim 2, wherein the hood enclosure (160) is made of transparent materials.

4. The system of claim 2, wherein the hood enclosure (160) further comprises a first secure strip (162) disposed adjacent to the first adjustment lock (130) and a second secure strip (164) disposed adjacent to the second adjustment lock (136), wherein when the hood enclosure (160) is in an storage position with the hood frame (150) rotating up, the first secure strip (162) is able to securely engage to the second strip (164) to keep the hood enclosure (160) in storage position.

5. The system of claim 4, wherein the first secure strip (162) engage to the second strip (164) with a fasten-and-loop mechanism, a zipper mechanism, a button mechanism.

6. The system of claim 1, wherein the secure means (149) is welding the central arm of the first tubular frame (110) or second tubular frame (120) to the window clamps (140).

7. The system of claim 1, wherein the secure means (149) is securing the central arm of the first tubular frame (110) or second tubular frame (120) to the window clamps (140) by a screw bolt.

* * * * *